United States Patent [19]

Roth

[11] Patent Number: 4,734,008

[45] Date of Patent: Mar. 29, 1988

[54] PUMP IMPELLER

[75] Inventor: Robert A. Roth, Grand Blanc, Mich.

[73] Assignee: General Motors Corporation, Detroit, Mich.

[21] Appl. No.: 876,776

[22] Filed: Jun. 20, 1986

[51] Int. Cl.[4] ..... F04D 5/00

[52] U.S. Cl. ..... 415/53 T; 415/77; 415/168; 415/198.2; 416/193 R; 417/201; 417/366

[58] Field of Search ..... 415/53 T, 77, 168, 198.2, 415/213 T; 416/193 R; 417/366, 423 R, 201

[56] References Cited

U.S. PATENT DOCUMENTS

| | | | |
|---|---|---|---|
| 3,031,974 | 5/1962 | Edwards | 417/69 |
| 3,418,991 | 12/1968 | Schultz et al. | 123/179 |
| 3,658,444 | 4/1972 | Rhodes et al. | 415/53 T X |
| 3,836,291 | 9/1974 | Bottcher et al. | 415/53 T X |
| 3,881,839 | 5/1975 | MacManus | 415/53 |
| 4,209,284 | 6/1980 | Lochmann et al. | 417/366 |
| 4,538,958 | 9/1985 | Takei et al. | 415/53 T |
| 4,629,399 | 12/1986 | Friebe | 417/201 |

*Primary Examiner*—Robert E. Garrett
*Assistant Examiner*—Joseph Pitko
*Attorney, Agent, or Firm*—Saul Schwartz

[57] ABSTRACT

An open-vane regenerative impeller for a fuel pump. The impeller has a ring-like body portion from which a plurality of open-vane impeller vanes extend radially out and a plurality of fan blades extend radially in. The impeller is disposed in a closed cavity between two pump bodies with the vanes in an annular pumping chamber and the fan blades in a cylindrical vapor collection chamber radially inboard of the pumping chamber. The fan blades operate to blow vapor out of the vapor collection chamber through a vapor discharge slot in one of the pump bodies when rotation of the impeller commences thereby to enhance the initial vacuum at the inlet port to the pumping chamber.

2 Claims, 5 Drawing Figures

PUMP IMPELLER

BACKGROUND OF THE INVENTION

1. Field of the Invention

This invention relates generally to automotive fuel pumps and, more particularly, to impellers in such pumps.

2. Description of the Prior Art

U.S. Pat. Nos. Lochmann et al 4,209,284, MacManus 3,881,839, and Shultz et al 3,418,991, all assigned to the assignee of this invention, describe submerged fuel pumps wherein electric motor portions of the pumps directly drive one or more open vane regenerative pump impellers. In each of the described pumps, the impellers have circumferential arrays of irregularly spaced, radially extending vanes which operate in well known regenerative fashion when the impellers rotate to pump fuel from an inlet at ambient pressure to a discharge at a higher pressure. In the pumps described in Shultz et al U.S. Pat. No. 3,418,991 and MacManus U.S. Pat. No. 3,881,839, the pump inlet body has one or more vapor discharge holes which intersect a wall of a pumping chamber around the impeller near the roots or radially innermost extremities of the spaces between the impeller vanes. When the impellers rotate, the heavier liquid fuel is centrifuged radially out and the lighter vapors are forced radially in and escape back to the tank through the vapor discharge holes. In the pump described in Lochmann et al U.S. Pat. No. 4,209,284, the impeller is disposed in the pumping chamber with predetermined extra side clearance relative to the chamber side walls. A vapor discharge slot in the pump inlet body at a location substantially radially inboard of the roots of the spaces between the impeller vanes opens into the fuel tank. When the impeller rotates, the vapors are driven radially inward along the sides of the impeller and escape through the discharge slot. With either of the described vapor discharge arrangements, if both the pump inlet port and the vapor discharge holes or slot are simultaneously uncovered when an attempt is made to start the engine, as might occur if there is fuel in the tank but the vehicle is parked on an incline, then the impeller may cause vapor to back-flow through the discharge holes or slot which retards or prevents sufficient vacuum at the pump inlet port to draw in sufficient liquid fuel to prime the pump. An impeller according to this invention operates in the anomalous situation just described to retard vapor back-flow through the vapor discharge opening and thereby enhance the vacuum at the pump inlet port.

BRIEF SUMMARY OF THE INVENTION

This invention is a new and improved impeller for a submerged fuel pump which reduces the tendency of fuel vapors to back-flow into the pumping chamber when the inlet port and vapor discharge openings are simultaneously uncovered. The new and improved impeller according to this invention includes, in addition to an outer circumferential array of vanes characteristic of this type of pump impeller, an inner fan structure which rotates as a unit with the impeller and includes fan blades which blow vapors away from the pumping chamber when the impeller begins to rotate with both the pump inlet port and the vapor discharge openings exposed only to vapor. In a preferred embodiment of the new and improved impeller, the fan blades define radially extending spokes between a hub drivingly connected to the motor shaft and a ring-like body of the impeller around which the pump vanes are arrayed.

DESCRIPTION OF THE DRAWINGS

Referring to FIGS. 1 and 2 of the drawings, an automobile fuel tank 10 has an interior fuel chamber 11 partially bounded by a bottom panel 12. A fuel pump 14 is suspended within the fuel chamber adjacent the bottom panel 12 on the lower end of a fuel discharge tube 16 through which the pump supplies fuel to the engine. The pump is normally submerged in fuel. A schematically illustrated wiring harness 18 conducts current to an electric motor portion of the pump whereby operation of the pump is synchronized with the state of the ignition system of the vehicle. An elastomeric bumper 22 connected to the pump 14 bears against the bottom panel 12 to control vibration.

Referring to FIG. 2, the electric motor portion of the fuel pump forms no part of this invention and may be of the type described in detail in either of the aforementioned U.S. Pat. Nos. 3,418,991 and 4,209,284. Briefly, the motor portion includes a cylindrical flux ring 28 disposed within a tubular housing 30 of the pump and an armature shaft portion 32. The shaft portion is rotatable about a longitudinal axis 34 of the pump in an internal volume 36 of the housing 30 which is in communication with the discharge tube 16.

Figure 1:
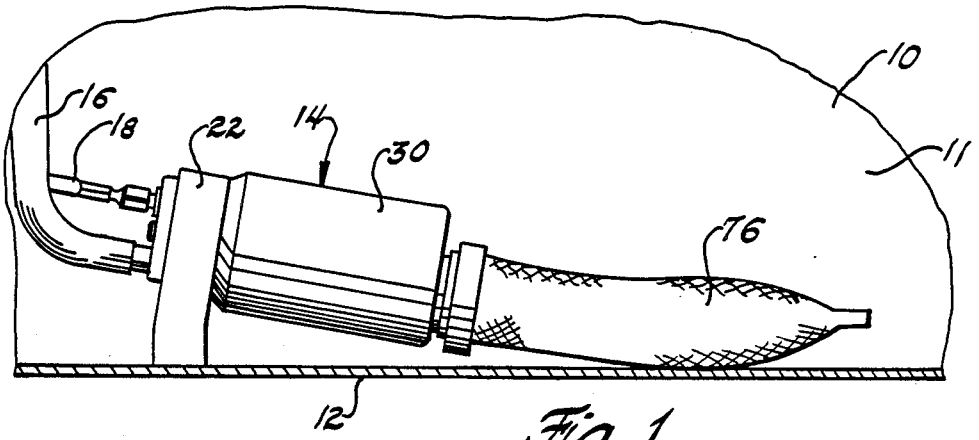
FIG. 1 is a fragmentary elevational view, partially in section, of a fuel tank having a submerged fuel pump therein incorporating an impeller according to this invention.

The armature shaft portion 32 simultaneously drives a high pressure pump 37 and a low pressure pump 38 within the housing 30 at the opposite end thereof from discharge tube 16. Except for the pump impeller described later, the high and low pressure pumps 37 and 38 are generally as described in the aforementioned Lochmann et al U.S. Pat. No. 4,206,284.

Figure 2:
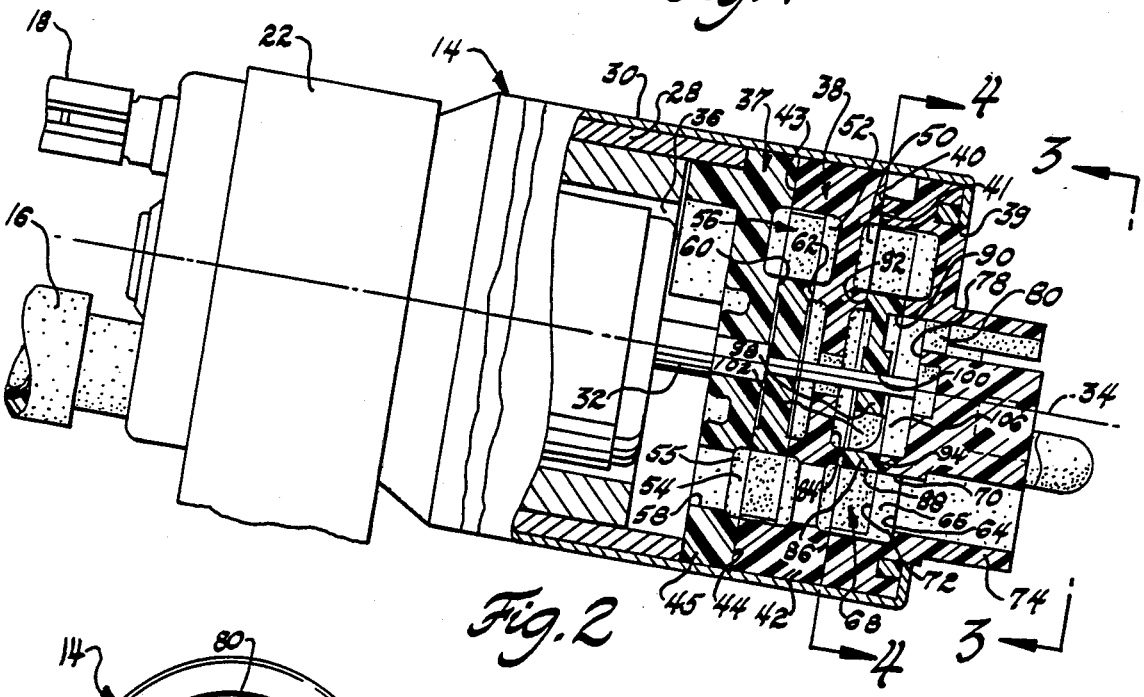
FIG. 2 is an enlarged, partially broken away view of the fuel pump shown in FIG. 1.
Figure 3:
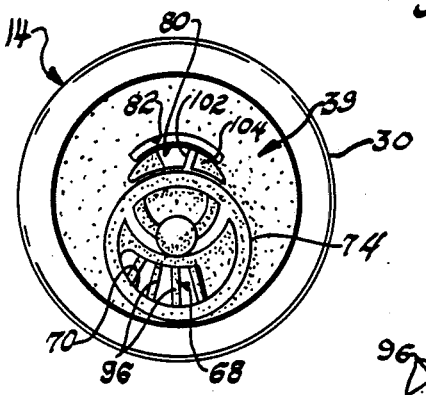
FIG. 3 is a sectional view taken generally along the plane indicated by lines 3—3 in FIG. 2.
Figure 4:
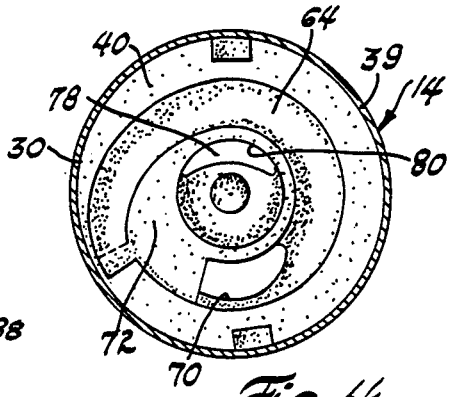
FIG. 4 is a sectional view taken generally along the plane indicated by lines 4—4 in FIG. 2.

Referring to FIGS. 2, 3 and 4 and briefly describing the high and low pressure pumps 37 and 38, a generally cylindrical inlet body 39 is disposed in the housing 30 adjacent the end thereof opposite discharge tube 16. The inlet body has a circular end surface 40 which abuts a circular end surface 41 of a cylindrical intermediate body 42 disposed in the housing 30 adjacent the inlet body. The intermediate body has another circular end surface 43 which abuts a circular end surface 44 on a discharge body 45 disposed in the housing adjacent the intermediate body. The intermediate body has a first generally circular cavity 50 in end surface 41 thereof and a second generally circular cavity 52 in end surface 43 thereof. The discharge body 45 has a generally circular groove 54 in end surface 44 thereof which cooperates with circular cavity 52 in defining an annular high pressure pumping chamber 55 around the peripheral portion of a disc-like high pressure impeller 56, which may be open or closed vane, and which is disposed in the circular cavity 52. A discharge port 58 in the discharge body between the internal volume 36 in the housing and the high pressure pumping chamber 55 conducts fuel from the pumping chamber to the internal volume for flow through the motor portion and out through the discharge tube 16. The high pressure impeller 56 is drivingly connected to the armature shaft portion 32. A pair of oppositely facing annular surfaces 60 and 62 on the intermediate and discharge bodies, respectively, are disposed in close proximity to the opposing sides of the high pressure impeller 56 and cooperate therewith in defining an inboard seal around the high pressure pumping chamber 55 on opposite sides of the impeller.

The inlet body 39 has a generally circular groove 64 in the end surface 40 thereof in alignment with the circular cavity 50 in the intermediate body which cooperates with the circular cavity in defining an annular low pressure pumping chamber 66 around an open vane regenerative impeller 68 according to this invention. The groove 64 extends angularly from an inlet port 70 in the inlet body 39 through an included angle of less than 360°, to a radially extending stripper surface 72 extending across the groove. A corresponding stripper surface, not shown, is defined on the intermediate body 42 opposite the stripper surface 72. A combination discharge/inlet port, not shown, in the intermediate body 42 extends between the low pressure pumping chamber 66 and the high pressure pumping chamber 55 so that the low pressure pump 38 discharges into the high pressure pump 37. A cylindrical flange 74 on the end of the inlet body 39 exposed to the fuel chamber 11 surrounds the inlet port 70 and provides a convenient location at which a screen 76 is attached to the pump.

As seen best in FIGS. 2 and 4, a shallow cylindrical depression 78 is formed in the end surface 40 of the inlet body 39 centered on the longitudinal axis 34 and located radially inboard of the groove 64. A vapor discharge slot 80 in the inlet body 39 intersects the depression 78 and extends through the inlet body to provide communication between the fuel chamber 11 and the depression 78. An arcuate flange 82 on the exposed surface of the inlet body is located above the vapor discharge slot 80. A circular depression 84 is formed in the bottom of circular cavity 50 in the intermediate body 42 opposite depression 78.

Figure 5:
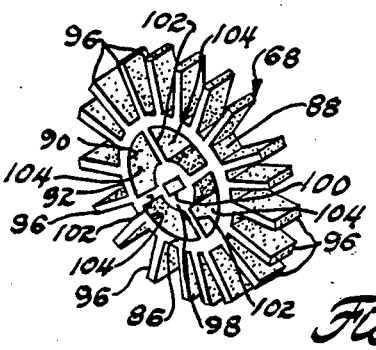
FIG. 5 is a perspective view of a pump impeller according to this invention.

With particular reference to FIGS. 2, 3 and 5, the low pressure impeller 68 according to this invention includes a ring-like body portion 86 defining an outer cylindrical surface 88, an inner cylindrical surface 90, and a pair of annular side faces 92 and 94. A plurality of irregularly spaced vanes 96, integral with the ring-like body 86, extend radially out from outer cylindrical surface 88. The impeller 68 further includes a hub 98 having a D-shaped bore 100 therethrough. The body portion 86 is connected to the hub 98 by a plurality of fan blades 102 integral with both the hub and the body portion and extending radially between the hub and inner cylindrical surface 90. The fan blades are separated by open spaces 104 in the annulus between the hub and the body portion.

The low pressure impeller 68 is disposed in the circular cavity 50 between the intermediate body 42 and the inlet body 39 with the bore 100 in the hub 98 drivingly connecting the impeller to the armature shaft portion 32. The annular side face 92 of the impeller is juxtaposed a seal surface portion of the bottom of the cavity 50 around the depression 84 therein in a plane perpendicular to the axis of rotation of the impeller with the inner cylindrical surface 90 of the impeller generally aligned with the outside diameter of the depression 84. The annular side face 94 of the impeller is juxtaposed a seal surface portion of the inlet body end surface 40 around the depression 78 therein with the inner cylindrical surface 90 of the impeller generally aligned with the outside diameter of the depression 78. The depressions 78 and 84 cooperate in defining a vapor collection chamber 106 located radially inboard of the low pressure pumping chamber 66. The fan blades 102 are disposed in the vapor collection chamber with the portions of the chamber lying on opposite sides of the impeller communicating through the spaces 104 between the fan blades 102.

In normal operation, both the inlet port 70 and the vapor discharge slot 80 in the inlet body 39 are submerged in fuel. With the motor armature shaft portion 32 rotating, the low pressure impeller 68 draws fuel through the inlet port 70 and discharges the same through the combined discharged/inlet port, not shown, to the high pressure pumping chamber 55 around the impeller 56. The fuel is discharged through the discharge port 58 of the high pressure pump into the internal volume 36 and then out through the fuel discharge tube 16. Because liquid is heavier than vapor, any vapor in the fuel entering the inlet port 70 is forced radially inward in the pumping chamber 66 by the liquid fuel which is centrifuged radially outward in the pumping chamber. The clearances between side faces 92 and 94 on the impeller 68 and the adjoining seal surface portion of the intermediate and inlet bodies 42 and 39, respectively permits unobstructed passage of the vapors radially inward to the vapor collection chamber 106. These fuel vapors then flow out through the vapor discharge slot 80 under the influence of pressure created by the continuous flow of vapor and/or small quantities of fuel from the pumping chamber 66 into the vapor collection chamber 106. During normal operation, the fan blades 102 may, but do not necessarily need to, enhance the flow of vapor out of the discharge slot 80.

When the vehicle is parked on an incline, the quantity of fuel remaining in the fuel chamber may combine with the steepness of the incline on which the vehicle is parked to produce the anomalous situation that the surface of the pool of fuel in the fuel chamber 11 overlaps the screen 76 but exposes both the inlet port 70 and the vapor discharge slot 80 to only tank vapors. In this situation, without the fan blades 102 on the impeller 68, the impeller 68 may back-flow vapor through the vapor discharge slot 80 when an attempt is made to start the engine. This back-flow is the result of the impeller vanes 96 expelling vapor from the pumping chamber 66 while drawing the same from both the inlet port 70 and from the vapor collection chamber 106, the latter vapors migrating radially out between the side faces 92 and 94 of the impeller and the adjoining seal surface portions on the intermediate and inlet bodies, respectively. Even though the screen 76 acts as wick for fuel in the fuel chamber 11, the back-flowing vapor prevents the impeller 66 from developing enough vacuum at the inlet port 70 to draw the wicked, liquid fuel into the inlet port. With the impeller 68 according to this invention, however, the fan blades 102 in the vapor collection chamber 106 operate to blow vapor from the collection chamber out through the vapor discharge slot 80. The fan blades thus create a pressure differential between the pumping chamber 66 and the vapor collection chamber 106 which retards the back-flow of vapor from the latter to the former. In this way, the initial vacuum at the inlet port 70 is enhanced enough to attract enough of the wicked, liquid fuel on the screen 76 into the pumping chamber 66 to prime the low pressure pump 38 and initiate fuel flow to the engine. Once the engine is started, the vehicle is driven away from the incline and the anomalous situation described above ceases to exist.

The embodiments of the invention in which an exclusive property or privilege is claimed are defined as follows:

1. An impeller for a vapor separating fuel pump, said fuel pump including an electric motor having a rotatable armature shaft portion, a first pump body defining a cavity for reception of said impeller and wherein said impeller is rotatable about an axis of said first pump body, a second pump body abutting said first pump body and closing said cavity, means on said first and second second pump bodies defining a pair of generally cylindrical depressions centered on said axis in a pair of opposite walls of said closed cavity, means on one of said first and said second pump bodies defining a vapor discharge slot extending therethrough to the corresponding one of said cylindrical depressions and, means on said first and said second pump bodies defining a pair of annular seal surfaces on respective ones of said opposite walls of said closed cavity around corresponding ones of said cylindrical depressions and in parallel planes perpendicular to said axis, said impeller comprising:

a ring-like body in said closed cavity centered on said axis and defining a cylindrical outer surface and a cylindrical inner surface and a pair of annular side surfaces disposed in parallel planes perpendicular to said axis, each of said annular side surfaces being juxtaposed a corresponding one of said pair of annular seal surfaces whereby said closed cavity is separated into a generally cylindrical vapor collection chamber centered on said axis and bounded at opposite ends by said cylindrical depressions and a substantially annular low pressure pumping chamber radially outboard of said vapor collection chamber and connected thereto by the clearance spaces between said impeller side surfaces and said annular seal surfaces, a plurality of open-vane pump vanes extending radially out from said outer cylindrical surface and disposed in said low pressure pumping chamber, a plurality of fan blades extending radially in from said inner cylindrical surface and disposed in said vapor collection chamber and operative to blow vapors in said vapor collection chamber out through said vapor discharge slot when rotation of said impeller commences, said fan blades being separated by open spaces therebetween through which the portions of said vapor collection chamber on opposite sides of said impeller communicate, and means on said impeller drivingly connecting said impeller to said motor armature shaft portion.

2. The impeller recited in claim 1 wherein said means on said impeller drivingly connecting said impeller to said motor armature shaft portion include a hub drivingly connected to said armature shaft portion, and means rigidly connecting a radial inboard end of each of said fan blades to said hub.

* * * * *